US005090218A

United States Patent [19]

Schuler et al.

[11] Patent Number: 5,090,218

[45] Date of Patent: Feb. 25, 1992

[54] LATCH NEEDLE FOR MACHINES PRODUCING KNIT GOODS

[75] Inventors: Bernhard Schuler, Sonnenbühl; Kurt Wiedenhöfer, Albstadt; Otto Langenstein, Albstadt; Siegfried Wissmann, Albstadt, all of Fed. Rep. of Germany

[73] Assignee: Theodor Groz & Söhne & Ernst Beckert, Albstadt-Ebingen, Fed. Rep. of Germany

[21] Appl. No.: 546,938

[22] Filed: Jul. 2, 1990

[30] Foreign Application Priority Data

Jun. 30, 1989 [DE] Fed. Rep. of Germany ..... 3921458

[51] Int. Cl.[5] ..... D04B 35/04

[52] U.S. Cl. ..... 66/121

[58] Field of Search ..... 66/116, 121, 122

[56] References Cited

U.S. PATENT DOCUMENTS 1,764,342 6/1930 Parlini ..... 66/121

4,498,315 2/1985 Wohlgemuth ..... 66/121

4,831,847 5/1989 Kanase et al. ..... 66/123

FOREIGN PATENT DOCUMENTS 586678 10/1933 Fed. Rep. of Germany ..... 66/121

672512 3/1939 Fed. Rep. of Germany .

3140386 4/1983 Fed. Rep. of Germany .

*Primary Examiner*—Werner H. Schroeder

*Assistant Examiner*—John J. Calvert

*Attorney, Agent, or Firm*—Spencer & Frank

[57] ABSTRACT

A latch needle for machines producing knit goods includes a needle shank having a slot, a needle head, and a latch. The needle shank has a first longitudinal plane of symmetry and the slot has a second longitudinal plane of symmetry. The latch is pivotably supported in the slot in the needle shank so as to be pivotable about a latch axis extending transversely to the second longitudinal plane of symmetry of the slot. The second longitudinal plane of symmetry intersects the first longitudinal plane of symmetry at an acute angle.

8 Claims, 2 Drawing Sheets

100
101
1
1'
3
3'
8
8'
10
10'
14
14'
15
15'
16
16'
18
19
19'
20
20a
21
22
23
30
40
40'
IV
VI

LATCH NEEDLE FOR MACHINES PRODUCING KNIT GOODS

CROSS-REFERENCE TO RELATED APPLICATION

The present disclosure relates to the subject matter disclosed in German application No. P 39 21 458.3 of June 30th, 1989, the entire specification of which is incorporated herein by reference.

BACKGROUND OF THE INVENTION

The present invention relates to a latch needle for machines producing knit goods, the needle including a needle shank, a needle head and a needle latch, the needle latch being mounted in a slot of the needle shank so as to be pivotable about a latch axis which is transverse to the longitudinal axis of the needle.

In order to produce knit goods having acceptable quality, the latch needles must open and close properly during loop formation in the knitting process. In view of this consideration, the pivotable latch is guided in a close fit within the slot of the needle shank. The latch is supported by bearings and has a noucat or latch spoon which is oriented toward the tip of the hook in such a manner that, in spite of axial and radial bearing play required to render the latch easily pivotable, the noucat lies properly on the needle head when the latch is closed.

The latch can be laterally deflected, however, due to the aforementioned bearing play. Additionally, the latch can be deflected by lateral forces which act on the latch and on the needle head during loop formation. These lateral forces can originate, for example in a circular knitting machine, due to carrying of the needle during rotary movement of the needle cylinder and the dial. Wear of the latch bearing causes additional axial play which results in further lateral deflection of the latch, particularly after a longer period of operation. The result in this eventuality is that the noucat of the latch no longer lies centrally on the needle head and instead brushes against a knitting tool, the knitting tool being, for example, a sinker or transfer jack adjacent to the needle. This interferes with the pivoting movement of the needle latch, resulting in the formation of longitudinal stripes or lines in the knit product. Moreover, additional lateral wear thereby occurs on the latch.

The undesirable lateral deflection of the needle latch is frequently exacerbated by the fact that, in some latch needle designs, the needle has a reduced shank height in its frontal region adjacent the head. For example, in order to save weight, particularly for needles intended for small circular knitting machines, the shank height between the needle butt and the groove is made to be as low as possible. Due to this low shank height, the stability of the latch needle in its shank region following the head is correspondingly reduced.

During loop formation, lateral forces are generated, for example, by the product removal device. Under the influence of the lateral forces acting on the head and groove region of the needle during loop formation, the needle is moved out of its symmetrical position toward its respective needle bed wall by the required play between adjacent needle bed walls and the needle shank, and the loop forming portion of the latch needle which projects from the needle bed is also inevitably pushed elastically somewhat to the side out of its original central position. A needle latch whose noucat is no longer oriented precisely toward the tip of the hook is thus brought closer to the adjacent knitting tool, this knitting tool being, for example, the adjacent sinker or transfer jack, so that pivoting movement of the latch causes the noucat of the latch to brush against the knitting tool.

In a latch needle disclosed in German Pat. No. 3,140,386, which corresponds to U.S. Pat. No. 4,498,315, an attempt to overcome the problems discussed in the foregoing, results in a needle having a latch, that has a shaft portion terminating in a noucat, wherein the noucat of the latch is set at an angle to the plane of symmetry of the shaft of the latch. The noucat is oriented to one side of the needle shank in order to ensure that in the closed position of the latch, when the latch is pushed against the wall of the slot due to lateral forces, the noucat rests on the needle head. The noucat is oriented such that it rests on the needle head both when the latch needle is at rest and also when the latch needle is engaged in the knitting process and is therefore subject to the aforementioned lateral forces. Such latch needles have been found to be quite satisfactory in practice. However, in a desire to further reduce the needle stroke and thereby increase knitting speeds, latch needles are produced today with a very short latch motion, with the length of the latch sometimes being only 2 mm including the noucat. With such short latches, however, limitations in manufacturing technology prevent the noucat of this type of needle from being placed at angles which would be required under these conditions.

SUMMARY OF THE INVENTION

It is therefore an object of the present invention to provide a latch needle whose latch closes properly independently of the length of the latch motion, even after relatively long periods of use, even while under the influence of lateral forces on the needle head, and in which the latch, during pivoting movement, remains sufficiently close to the longitudinal plane of symmetry of the needle that brushing against adjacent knitting tools, particularly sinkers or transfer jacks, is reliably prevented.

The above and other objects are accomplished according to the invention in that a latch needle for machines producing knit goods includes:

a needle shank having a slot, the needle shank having a first longitudinal plane of symmetry and the slot having a second longitudinal plane of symmetry;

a needle head; and a latch pivotably supported in the slot in the needle shank so as to be pivotable about a latch axis extending transversely to the second plane of symmetry, wherein the second longitudinal plane of symmetry intersects the first longitudinal plane of symmetry at an acute angle.

Due to the fact that, according to the invention, the longitudinal plane of symmetry of the slot is not disposed in the center plane of the needle, it is ensured that, when the needle is installed in the machine, even under the influence of the lateral forces generated during the loop forming process, the noucat of the needle latch cannot be pushed laterally to an extent which would be significantly beyond the plane of symmetry of the needle during pivoting movement of the latch. This prevents the latch from brushing against an adjacent knitting tool. At the same time, the proper, essentially central contact of the noucat on the needle head remains in effect.

In a first embodiment, the longitudinal center plane of the slot may be arranged so that it is at an acute angle with respect to the longitudinal plane of symmetry of the needle shank about a vertical axis extending from the upper side of the needle to the back of the needle. In this embodiment, the slot, when seen from the top looking onto the upper side of the needle, is in an oblique position relative to the plane of symmetry of the needle shank. As an alternative or additionally, the arrangement may also be such that the longitudinal plane of symmetry of the slot is arranged in a position in which it is tilted to the side about a longitudinal axis which extends in the longitudinal direction of the needle shank. The acute angle enclosed between the longitudinal plane of symmetry, the latch and the longitudinal plane of symmetry of the needle shank, which is characteristic for the lateral pivoting and/or tilting of the longitudinal plane of symmetry of the slot, preferably has its vertex disposed in the region of the slot. However, depending on the construction of the needle and the geometric relationships of the latch needle, other embodiments are possible in which the vertex of this acute angle comes to lie outside of the region of the slot.

The magnitude of the aforementioned acute angle depends, among others, on cheek height of the needle, the thickness of the needle shank, and the installation conditions of the needle in the associated knitting machine. This acute angle preferably lies in a range between 0.5° and 6°.

In order to further improve the lateral guidance of the latch needle and increase its stability, the needle shank can include at least one raised portion in the region of its transition toward the groove on its upper side so as to give improved support to the needle in the needle bed of the machine, so that the needle shank lies securely against the needle bed walls. This raised portion may, even under critical operating conditions as well as the influence of lateral forces, prevent the needle shank region adjacent to the needle head from being tilted about its longitudinal axis in the direction of the needle bed wall opposite to the direction of rotation of the needle cylinder beyond the amount due to unavoidable play between the latch needle and the needle bed walls. The loop forming portion of the latch needle, which projects from the needle bed and includes the needle head and the latch, is thus additionally held in a position ensuring malfunction-free operation.

Machines for the production of knit goods in which the novel latch needles can be employed are preferably understood to include knitting machines, particularly circular knitting machines which operate with latch needles and in which, due to technical considerations, lateral forces are generated, for example during the rotary movement of the needle cylinder and the dial or, as a result of product removal. These lateral forces are generated at the needle head and at the latch and the needle shank region following it.

The invention will be described in greater detail below with reference to an embodiment which is illustrated in the drawings.

DETAILED DESCRIPTION OF THE PREFERRED EMBODIMENTS

Figure 1:
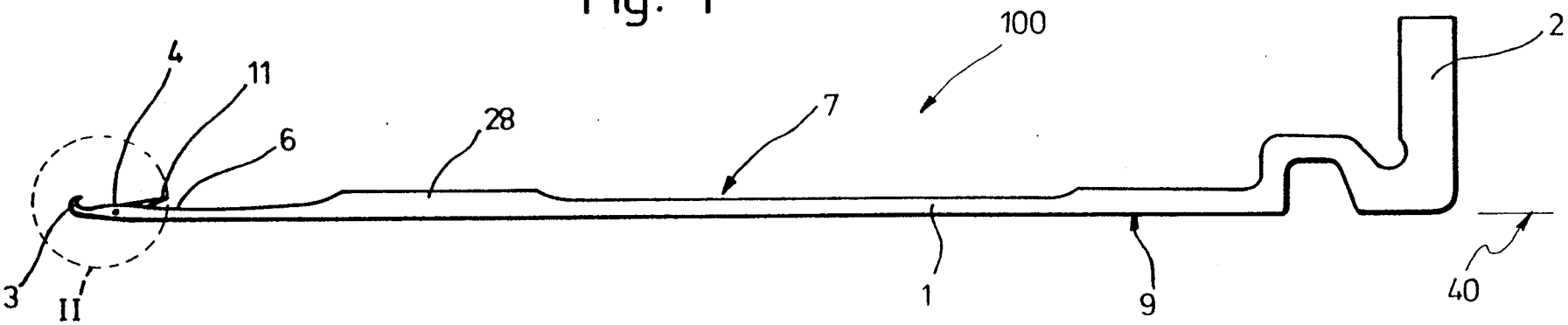
FIG. 1 is a side elevational view of a latch needle according to the invention.

A latch needle 100 is shown in FIG. 1, and corresponds generally to that specified in DIN ISO 8119. The latch needle 100 includes a cheek 4, a groove 6 formed in an upper side 7 of the needle, and a needle shank 1 which at one end has a butt 2 and at the other end a needle head or hook 3. The hook 3 has a tip 14. The latch needle 100 has a longitudinal axis 40 and a longitudinally extending, elongate slot 8 formed in the needle shank 1 in the region of the cheek 4.

A latch 11 has a pivot end disposed in the slot 8 and is pivotable about a pivot axis 120, the pivot axis 120 being oriented generally transversely to a longitudinal plane of symmetry 15 (shown in FIG. 3) of the slot 8. The slot 8 includes a back punch 10 which opens toward a back side 9 of the needle shank 1 and is approximately disposed below the pivot axis 120 of the latch 11. It is alternatively possible according to the invention to provide needle constructions corresponding to the latch needle 100 in which no back punch 10 exists.

Figure 2:
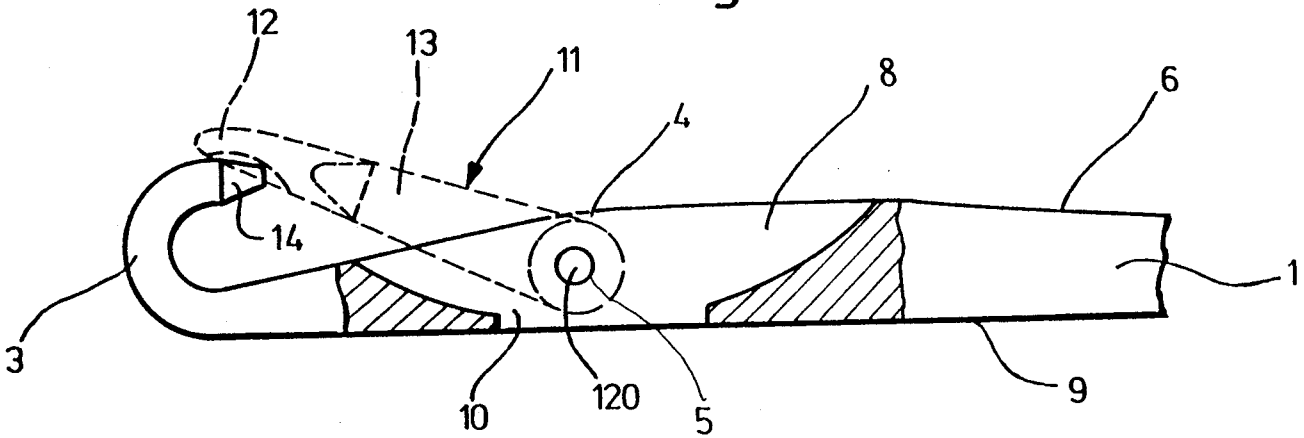
FIG. 2 is a side elevational view, partially in section, of the head and adjacent portions of the latch needle of FIG. 1, and which correspond to the region designated at II in FIG. 1.

The latch 11 is seated in the slot 8 such that it can pivot about the pivot axis 120. On its end facing away from the pivot axis 120, the latch 11 has a noucat 12 which is seated on a latch shaft 13 entering into the slot 8, the latch shaft 13 including a bearing bore (unnumbered) for receiving a pin or bearing member 5 which rotatably supports the latch 11 within the bearing bore. A closed position of the latch 11 is shown in FIG. 2, in which the noucat 12 rests centrally on the tip 14 of the hook 3.

Figures 3, 4, 5, 6:
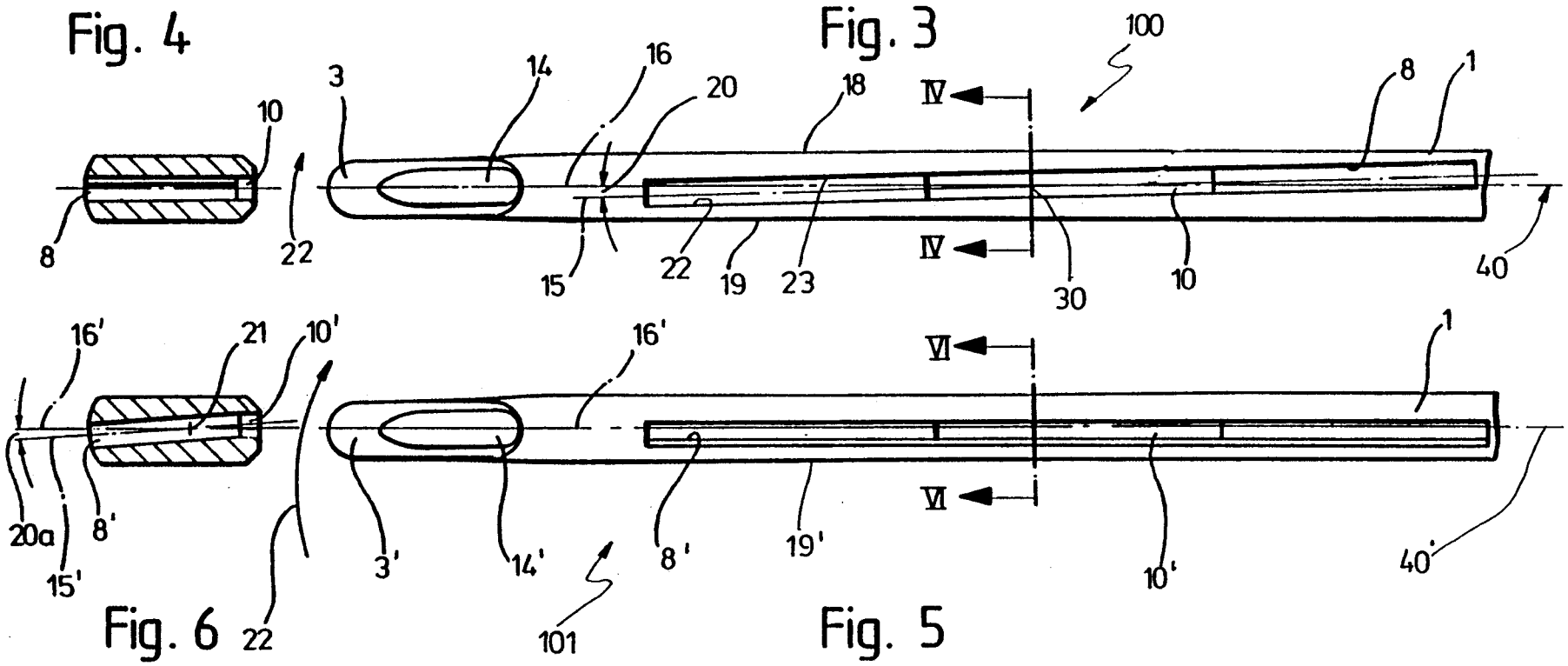
FIG. 3 is a top plan view of an embodiment of the latch needle of the type shown in FIG. 1 with the needle latch omitted.
FIG. 4 is a sectional view of the latch needle of FIG. 3 taken along line IV—IV of FIG. 3.
FIG. 5 is a top plan view of another embodiment of a latch needle of the type shown in FIG. 1, with the needle latch omitted.
FIG. 6 is a sectional view of the latch needle of FIG. 5 taken along line VI—VI of FIG. 5.

The needle shank 1 is preferably formed by being punched out of sheet metal (e.g. steel band) or produced from steel wire, such that it has a longitudinal plane of symmetry 16 as shown in FIG. 3. The needle shank 1 has sides 18 and 19. The slot 8 is preferably formed such that its longitudinal plane of symmetry 15 extends at an acute angle 20 to the longitudinal plane of symmetry 16 of the needle shank 1, as measured in a plane (i.e., the plane of the paper in which FIG. 3 lies) which is orthogonal to the longitudinal plane of symmetry 16 of the needle shank 1. The slot 8 preferably has substantially parallel lateral flanks 22 and 23, and a concave lower surface. The slot 8 extends through the back punch 10.

The vertical plane of symmetry 15 of the slot 8 intersects the longitudinal plane of symmetry 16 of the needle shank 1 along a line 30. The line 30 is indicated by a single point in FIG. 3 and extends transversely the plane of FIG. 3. This means that the vertex of the acute angle 20, indicated by the line 30, lies within the region of the slot 8.

FIGS. 5 and 6 show another embodiment in which a latch needle 101 similar to the latch needle 100, and which includes a needle shank 1' having a needle head or hook 3' and a longitudinal plane of symmetry 16'. The hook 3' has a tip 14'. The latch needle 101 has a longitudinal axis 40', a longitudinally extending, elongate slot 8' formed in the needle shank 1' to receive a latch (not shown) corresponding to the latch 11 of FIG. 2, and a back punch 10'. The slot 8' has a longitudinal plane of symmetry 15' (shown in FIG. 5) of the slot 8'. In the embodiment shown in FIGS. 5 and 6, the longitudinal plane of symmetry 15' is tilted laterally relative to the longitudinal plane of symmetry 16' and intersects it along a line 21 as shown in FIG. 6, the line 21 extending in the longitudinal direction of the needle shank 1'. The longitudinal plane of symmetry 15' intersects the longitudinal plane of symmetry 16' at an acute angle 20*a*.

In the embodiments shown in FIGS. 3 and 5, the acute angles 20 and 20*a* each preferably lie in a range between 0.5° and 6°. In exceptional cases, deviations from this range in either angular direction are also permissible within the scope of the invention.

The arrangement of the slot 8 in the embodiment according to FIGS. 3 and 4 may also be combined with that of the embodiment according to FIGS. 5 and 6 so that the slot 8 lies "askew" in the needle shank 1. In this case, a slot corresponding to the slot 8, and having a longitudinal plane of symmetry which corresponds to the longitudinal plane of symmetry 15 would intersect a longitudinal plane of symmetry which corresponds to the longitudinal plane of symmetry 16 at an acute angle corresponding both to the acute angle 20 as well as to the acute angle 20*a*. In this case, these two acute angles 20 and 20*a* may be identical or, preferably, of different angular sizes.

In a rest position of the latch needle 100, due to the oblique position of the slot 8 in the embodiment of FIGS. 3 and 4, the latch 11, whose shaft 13 is laterally guided in the slot 8, comes to lie in such a position when closed that its noucat 12 rests on the needle tip 14 while being displaced to one side. If the latch needle 100 shown in FIGS. 3 and 5 is inserted, for example, into the needle cylinder of a circular knitting machine which rotates clockwise as indicated by an arrow 22 in FIG. 3, the latch 11 and the needle head 3 are somewhat bent laterally outwardly by attacking lateral forces so that the needle shank 1 is pressed, on the side 19 of the latch needle 100 which is in the rear when seen in the direction of rotation 22, against the associated side wall of the needle bed. Due to the oblique orientation of the slot 8, however, it remains ensured that the noucat 12 properly covers the tip 14 and that the longitudinal plane of symmetry 15 of the slot 8 cannot be pushed laterally beyond the longitudinal plane of symmetry 16 of the needle shank 1. In this way the noucat 12 is reliably prevented from brushing against an adjacent sinker or transfer jack, even when the needles are arranged in very close proximity.

Similarly, in the embodiment of FIGS. 5 and 6, in a rest position of the latch needle 101, due to the tilted position of the slot 8', a latch corresponding to the latch 11 of FIG. 2 is laterally guided in the slot 8' and comes to lie in such a position when closed that its noucat, which corresponds to the noucat 12 of FIG. 2, rests on the needle tip 14' while being displaced to one side. When the latch needle 101 shown in FIGS. 5 and 6 is inserted, for example, into the needle cylinder of a circular knitting machine which rotates clockwise as indicated by an arrow 22 in FIG. 5, the latch corresponding to the latch 11 in FIG. 2 and the needle head 3' are somewhat bent laterally outwardly by attacking lateral forces so that the needle shank 1' is pressed, on a side 19 of the latch needle 101 which is in the rear when seen in the direction of rotation 22, against the associated side wall of the needle bed. .Due to the oblique orientation of the slot 8', however, it remains ensured that the noucat corresponding to the noucat 12 in FIG. 2 properly covers the tip 14' and that the longitudinal plane of symmetry 15' of the slot 8' cannot be pushed laterally beyond the longitudinal plane of symmetry 16' of the needle shank 1'. In this way the noucat, which corresponds to the noucat 12 of FIG. 2, is reliably prevented from brushing against an adjacent sinker or transfer jack, even when the needles are arranged in very close proximity.

The above-described two embodiments of a latch needle both include a grooved or hollowed noucat corresponding to the noucat 12 of FIG. 2. However, the present invention can be employed in a similar manner for latch needles having a grooved or concave needle head or hook instead of the convex needle head or hook 3 shown in FIG. 2, and is, in general, independent of the configuration of the contact face between the needle latch 11 and the upper side 7 of the on the needle head or hook 3.

As can be seen in FIG. 1, the needle shank 1 includes a raised portion 28 on its upper side 7 in the region of a transition to the groove 6. If necessary, this raised portion 28 may also be shorter or may be replaced by a plurality of raised portions that are spaced one behind the other, and if so required may also be substantially shorter than that shown in the drawing. The raised portion 28 prevents the latch needle, corresponding to the latch needles 100 and 101, from being tilted or twisted between the needle bed walls to a degree beyond the play required for operation under the influence of the lateral forces attacking the respective one of needle heads 3 or 3' which, under difficult operating conditions, would still raise the danger of the respective latch corresponding to the latch 11 from brushing against the adjacent sinker or transfer jack. The loop forming portion of the latch needle 100 projecting from the needle cylinder, together with needle head 3 and the needle latch 11, are thereby held in the correct position within the needle bed for operation without interference even under these conditions.

In the foregoing description of FIGS. 3 and 5, the relationships are described for a circular knitting machine rotating in a clockwise direction which is indicated by the corresponding one of the arrows 22. For a circular knitting machine rotating in a counterclockwise direction, as widely encountered in practice, conditions would be reversed from the foregoing description.

While in the embodiments according to FIGS. 3 and 5 show the respective vertexes of the acute angles 20 and 20*a*, indicated respectively by the lines 30 and 21, as lying within the regions of the respective ones of the slots 8 and 8', these vertexes can lie outside these regions. This can occur in the case, for example, where the respective ones of the slots 8 and 8' are relatively short compared to the width of the needle shank 1 and are sufficiently off-center from the respective ones of the longitudinal planes of symmetry 16 and 16'.

It will be understood that the above description of the present invention is susceptible to various modifications, changes and adaptations, and the same are intended to be comprehended within the meaning and range of equivalents of the appended claims.

What is claimed is:

1. A latch needle for machines producing knit goods, comprising:

a needle shank having a slot, said needle shank having a first longitudinal plane of symmetry and said slot having a second longitudinal plane of symmetry;

a needle head; and a latch pivotably supported in said slot so as to be pivotable, into and out of contact with said needle head, about a latch axis extending transversely to said second longitudinal plane of symmetry; wherein said second longitudinal plane of symmetry intersects said first longitudinal plane of symmetry at an acute angle.

2. A latch needle as defined in claim 1, wherein said needle shank has an upper and a lower side, and said second longitudinal plane of symmetry intersects said first longitudinal plane of symmetry along a vertically-oriented line which extends between said upper side of said needle shank and said back of said needle shank.

3. A latch needle as defined in claim 1, wherein said needle shank has a longitudinal extent, and said second longitudinal plane of symmetry intersects said first longitudinal plane of symmetry at a line which is generally parallel to said longitudinal extent of said needle shank.

4. A latch needle as defined in claim 2, wherein said acute angle has its vertex in a region of said needle shank containing said slot.

5. A latch needle as defined in claim 1, wherein said acute angle is in a range of approximately 0.5° and 6°.

6. A latch needle as defined in claim 1, wherein said needle shank further comprises an upper side, at least one raised portion on said upper side, and a groove in said upper side; and wherein said raised portion extends adjacent said groove.

7. A latch needle as defined in claim 1, wherein said needle shank includes a back punch adjacent said curved groove adjacent a back side of said needle shank.

8. A latch needle as defined in claim 3, wherein said acute angle has its vertex in a region of said needle shank containing said slot.

* * * * *